US005878876A

United States Patent [19]

Galbierz et al.

[11] Patent Number: 5,878,876

[45] **Date of Patent: *Mar. 9, 1999**

[54] MULTI-PACK CARRIER FOR MOLDED BOTTLES AND CONTAINERS

[75] Inventors: Richard T. Galbierz; Michael A. Galbierz, both of St. Louis, Mo.

[73] Assignee: Eco-Pak Products, Inc., St. Louis, Mo.

[ * ] Notice: The term of this patent shall not extend beyond the expiration date of Pat. No. 5,590,776.

[21] Appl. No.: 951,885

[22] Filed: Oct. 16, 1997

[51] Int. Cl.[6] ..... B65D 75/00

[52] U.S. Cl. ..... 206/158; 206/148; 206/153

[58] Field of Search ..... 206/145, 147, 206/148, 149, 153, 155, 158, 427

[56] References Cited

U.S. PATENT DOCUMENTS

| | | | |
|---|---|---|---|
| 4,621,734 | 11/1986 | Heijnen et al. | 206/427 |
| 4,736,977 | 4/1988 | Killy | 206/148 |
| 5,445,262 | 8/1995 | Sutherland | 206/158 |
| 5,487,464 | 1/1996 | Galbierz et al. | 206/149 |
| 5,590,776 | 1/1997 | Galbierz et al. | 206/158 |
| 5,639,137 | 6/1997 | Bakx | 206/158 |
| 5,706,936 | 1/1998 | Bernstein | 206/158 |

*Primary Examiner*—David T. Fidel
*Attorney, Agent, or Firm*—Polster, Lieder, Woodruff & Lucchesi

[57] ABSTRACT

A carrier for holding and transporting a plurality of bottles includes a top panel, a bottom panel, and two side panels extending between said top and bottom panels to form a sleeve through which the bottles extend. When the carrier is formed to carry six or more bottles, the top panel has at least two rows of outboard apertures which are adapted to receive the bottles to engage the bottles to retain the bottles in the carrier. The bottom panel extends between the side panels and also includes at least two rows of outboard surrounding apertures which are aligned with, but radially offset from the outboard apertures of the top panel, such that the centers of the bottom panel outboard apertures are closer to the side panels than are the outboard apertures of the top panel. If the carrier includes inboard apertures in the top and bottom panel, the inboard apertures of the top and bottom panel are preferably concentric with each other. Further, the bottom panel outboard apertures are larger than the bottom panel inboard apertures. Lastly, when bottles are introduced into the carrier, the position of the outboard apertures and the size of the side panels cause the side panels to slope downwardly and inwardly. The carriers can be provided with a flexible handle to facilitate carrying heavy packages (i.e., 12 packs or greater).

35 Claims, 12 Drawing Sheets

MULTI-PACK CARRIER FOR MOLDED BOTTLES AND CONTAINERS

CROSS-REFERENCE TO RELATED APPLICATIONS

The invention shown and described herein is an improvement of the box-top bottle carrier shown and described in our U.S. Pat. No. 5,590,776, and to our pending application, Ser. No. 895,055, filed Jul. 16, 1997, now U.S. Pat. No. 5,845,776, both of which are incorporated herein by reference.

STATEMENT REGARDING FEDERALLY SPONSORED RESEARCH OR DEVELOPMENT

Not Applicable.

BACKGROUND OF THE INVENTION

This invention relates to multi-pack carriers for bottles and other molded containers, and in particular to a multi-pack carrier which is simple to manufacture, easy to assemble, and which will securely hold bottles and containers therein.

Multi-pack carriers have long been available to facilitate the carrying of bottles or the like so that customers can buy containers of beverages in packages. Many of these carriers, however, lack total consideration of the economics of high speed manufacture, bulk shipment of the carriers in a flat state, and ease and speed of assembly of the carrier. Other available carriers, while suitable for their intended purpose, are complicated in construction, in their assembly, and do not facilitate removal of bottles from the carrier by the consumer.

The most common multi-pack beverage containers for bottles is the basket carrier, which, as the name denotes, is formed into a basket which receives the bottles. Six-packs of soda or beer are often seen in such basket carriers. Basket carriers, as is known, form a plurality of individual compartments which separate the bottles from each other. Basket carriers are formed from complex blanks which produce a significant amount of waste. Because the blanks for basket carriers are complex, they require complex machinery to assemble the basket carriers. Typically, the basket carriers are formed and placed into a shipping case and filled with empty bottles. The bottles in the basket are then transported to the filling plant. At the filling plant, the bottles are removed from the basket carrier, washed, and then placed on the filling line. Once the bottles are filled and capped, crowned, or otherwise closed and labeled, they are placed back in the carrier. Basket carriers also create difficulties in the store. They are difficult to stack, and when they are, a basket can catch the crown of a bottle in a basket adjacent the selected basket. This can cause the bottles in the adjacent basket to fall, resulting in breakage and loss of product, as well as associated revenue for the store.

To overcome the problems associated with basket carriers, many different carriers have been provided which are in the form of flat or planar carriers which accept the bottles or in the form of sleeves through which the bottles extend. In our above noted U.S. Pat. No. 5,590,776, we disclose a six-pack box-top carrier, the basic construction of which lends itself well to being used for a variety of designs or bottle types. There however is a demand for carriers which can hold up to twelve or more bottles. In our just noted U.S. Patent, we disclose that two six-packs can be combined to form a twelve-pack. However, the mechanics of a single twelve-pack (as opposed to a twelve-pack made from two connected six-packs) are significantly different than for a six-pack, and such differences must be overcome in order to make a single or one-piece box-top carrier which can hold twelve or more beverage bottles.

There is also a demand for a basic design of a carrier which can easily be modified to carry a desired number of beverage containers and which can easily be modified to carry different sizes of beverage containers.

Glass bottles are relatively tall and have narrow diameters when compared to beverage cans. Thus, when the bottle is held by its neck, the bottle may form a pendulum with respect to the carrier and be able to swing when held by the carrier. If the bottles are allowed to swing too much, they can contact each other and break. Regulatory and practical requirements dictate against a construction which will allow the bottle to swing in the carrier. In our U.S. Pat. No. 5,590,776, which is incorporated herein by reference, we disclosed a box-top carrier which will substantially prevent bottles, when placed in the carrier, from swinging relative to the carrier and to each other. That carrier, however, can be improved upon, and in our above noted application Ser. No. 895,055, the carrier was modified to allow bottles, when packaged with the carrier, to be inserted into a shipping case.

BRIEF SUMMARY OF THE INVENTION

One object of the present invention is to provide a multi-pack carrier which will securely carry a plurality of bottles (including PET bottles) or other molded containers.

Another object is to provide such a carrier which can carry a small array of containers (e.g., a two- or three-pack) or a large array of containers (e.g., a twelve pack or greater).

Another object is to provide a flexible handle to facilitate carrying of heavy packages (i.e. twelve packs).

Another object is to provide such a carrier which maximizes the planar strength of the carrier.

Another object is to provide such a carrier which will minimize or substantially prevent the bottles from impacting each other when they are carried in the carrier.

Another object is to provide such a carrier in which the bottles and containers are tightly bound together.

Another object is to provide such a carrier which may be produced at high speed and shipped in bulk in a flat state and which is easy to erect and apply to a group of bottles, either manually or by machine.

Another object is to provide such a carrier which may be applied to bottles while the bottles are in their shipping cases.

These and other objects will become apparent to those skilled in the art in light of the following disclosure and accompanying drawings.

Briefly stated, a carrier for holding and transporting a plurality of bottles includes a top panel, a bottom panel, and two side panels extending between said top and bottom panels. The panels are connected to each other to define a sleeve which fits over the tops of the bottles and which is adapted to retain the bottles in the sleeve.

The top panel includes a plurality of apertures through which the bottle neck extends and which are adapted to engage the bottle to hold the bottle in the carrier. Preferably, the top panel has at least a top ply and a second ply. The top ply has a plurality of surrounding apertures through which the bottle necks extend. The second ply includes a plurality of container receiving apertures formed concentrically with and having a diameter smaller than said surrounding apertures of the top ply. Slits extend from an edge of the container receiving apertures to define a plurality of tabs around the container receiving apertures. The diameter of the container receiving aperture is smaller than the bottle diameter at the point the container receiving aperture engages the bottle. The tabs engage the bottle (typically at the take-out bead or cap of the bottle) to hold the bottle in the carrier. However, the tabs could engage a rib or groove in the bottle.

The bottom panel has apertures through which the bottles extend and which are generally aligned with apertures of the top panel. To improve the overall strength of the carrier, the bottom panel has continuous and uninterrupted edges extending between the side panels. The side panels have a height such that the bottom panel is placed in tension when bottles are placed in the carrier and such that an arc is induced in the bottom panel when said bottles are inserted in said carrier. The arc which is induced in the bottom panel can cause a fold or break-line to form in the bottom panel. To control where the break-line forms, and to maintain the aesthetic appearance of the carrier, a break-line can be formed in the bottom panel. The break-line is preferably formed at the approximate location where the break-line would occur naturally, and runs generally parallel to the side panels. This basic sleeve design is very adaptable, and may be used to form a variety of carriers which can hold different numbers of bottles of different sizes and types. The invention is shown and described with respect to a twelve-pack, a six-pack, and a three-pack. However, it will be understood, that the carrier could be adapted for other sizes as well.

The six-pack carrier includes two rows of three apertures each, and the twelve pack carrier, in one embodiment, includes four rows of three apertures each. In a second embodiment, the twelve-pack carrier includes three rows of four apertures each. In the twelve-pack, the two rows adjacent the side panels are referred to as outboard apertures and the rows between the outboard apertures are referred to as inboard apertures. In the six pack, for PET bottles, the bottom panel apertures are offset outwardly from the top panel apertures such that the center of the bottom panel apertures are closer to the side panels than the center of the top panel apertures. If the centers of the top and bottom panel apertures were aligned, the aperture in the bottom panel would have to be generally elliptical. In the twelve-pack, the bottom panel outboard apertures are similarly offset outwardly from the top panel outboard apertures. The outwardly directed offset of the bottom panel apertures relative to the top panel apertures causes the side panels to slope inwardly and downwardly. When the bottles are placed in the carrier, the outer edges of these apertures contact the bottle. The slope induced in the side panels increases this contact force when the carrier is lifted. This binds the bottles together and moves them toward the center of the carrier. This will keep the bottles in a tight formation and substantially prevent movement of the bottles relative to one another. Because the bottles are pulled inwardly, when the carrier is applied to a group of bottles, the top panel apertures adjacent the side panels may have to be moved slightly inward. Thus, the center-to-center distance between the top panel apertures of adjacent rows is less than the center-to-center distance of the bottles. For example, for bottles having a 2½" diameter, the center of the top panel apertures will be less than 2½" apart.

In the twelve-pack carriers, the inboard apertures of the top and bottom panels are preferably generally concentric with each other. Further, the bottom panel outboard apertures are larger than the bottom panel inboard apertures. The bottom panel inboard apertures are sized to be at least equal to or larger than the diameter of the inboard surrounding apertures. Further, they are at least equal to a diameter of the bottle received in the carrier at the point where the bottom panel inboard apertures surround the bottle. This will allow for the bottle to pass through the bottom panel aperture. Preferably, the bottom panel inboard apertures are approximately equal to the diameter of the bottle at the point of engagement of the inboard apertures with the bottle. Because of the weight that is carried by the twelve-pack, the side panels can be dimensioned so that the arch induced in the bottom panel will bring the bottom panel into contact with the top panel. Finger holes are then provided which extend through the top and bottom panels to facilitate handling of the carrier when filled with bottles. The holes in the bottom panel are preferably elongate so that when the carrier is lifted, the bottom panel will not be grabbed by the consumer, so that the carrier, with bottles, will be carried by the top panel only. The bottom panel holes, however, can be sized, so that the bottom panel is grasped, so that the carrier is lifted by both the top and bottom panels. Alternatively, a paperboard handle can be provided which is formed integrally with the carrier. The use of the finger holes enables the bottom panel to not only further bind the bottles in a package together when the package is lifted, but it offers strength and support to the lifting of the package.

The carrier, alternatively, can be provided with a flexible handle which will lie flat when the carrier is folded flat and when the carrier is applied to a group of bottles. The handle is movable to a carrying position in which it extends above the plane of the carrier top panel when the handle is grabbed to carry a package of bottles. The handle includes a central handle body, a neck extending from each end of the handle body, and a head at the end of each neck. The back edges of the heads preferably slope rearwardly and outwardly from the necks of the handle. The carrier top panel includes an opening through which the handle slides. This handle opening may be round, like the finger openings, but preferably is crescent or U-shaped, or a slit. The handle necks have a width smaller than the width of the handle body and handle heads. The handle heads each have a pair of barbs which engage a bottom surface of the top panel when the handle is moved to its carrying position. The heads are preferably tapered at their front ends. The barbs are defined by slits extending inwardly from the back edges of the handle heads. The slits which define the barbs slope inwardly from the handle head back surface. The back corners of the barbs are blunted or squared off, so that the back corners of the barbs will not be pointed.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes adaptations, variations, alternatives and uses of the invention, including what we presently believe to be the best mode of carrying out the invention.

Figure 1:
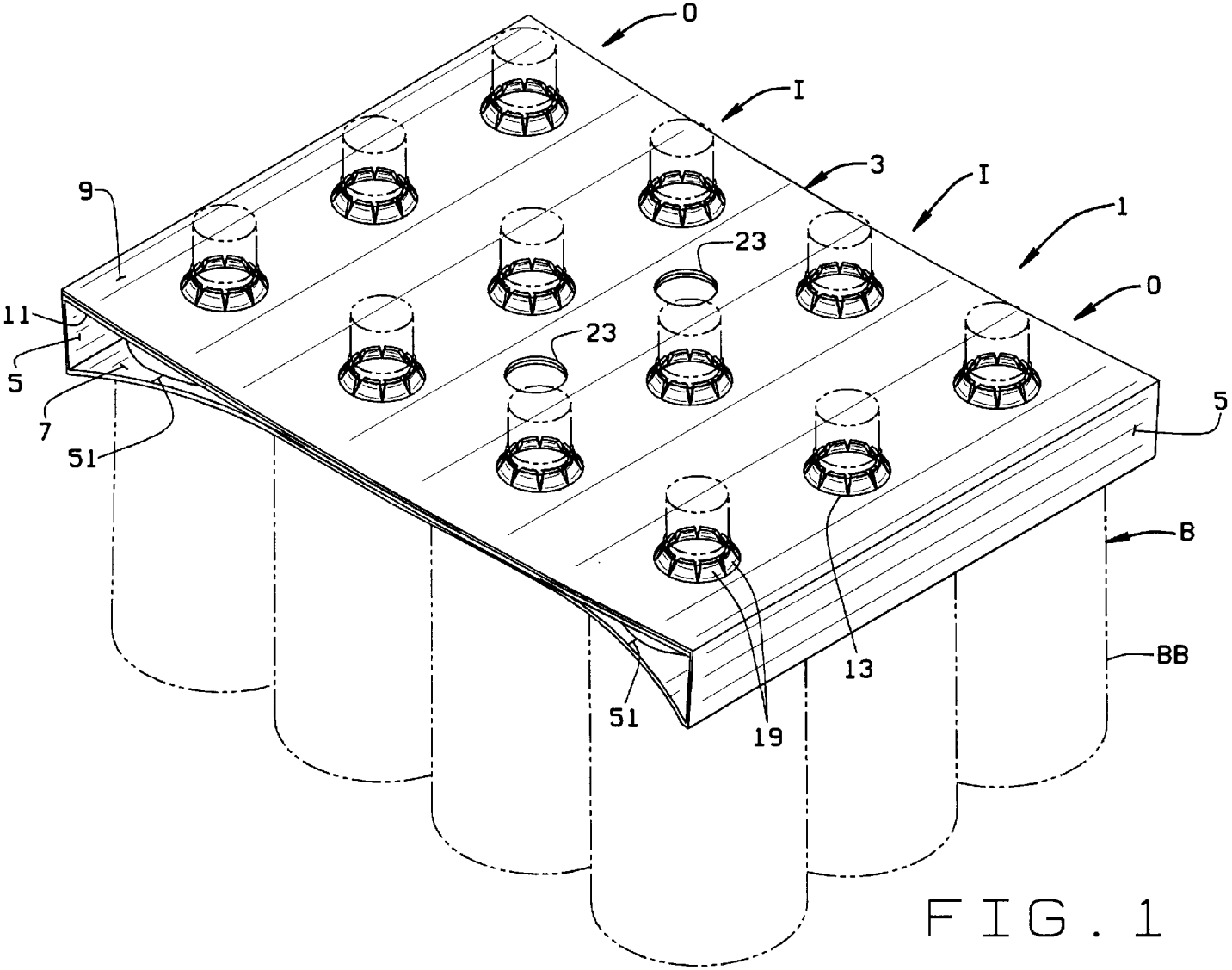
FIG. 1 is a perspective view of a twelve-pack box-top carrier of the present invention.
Figure 2:
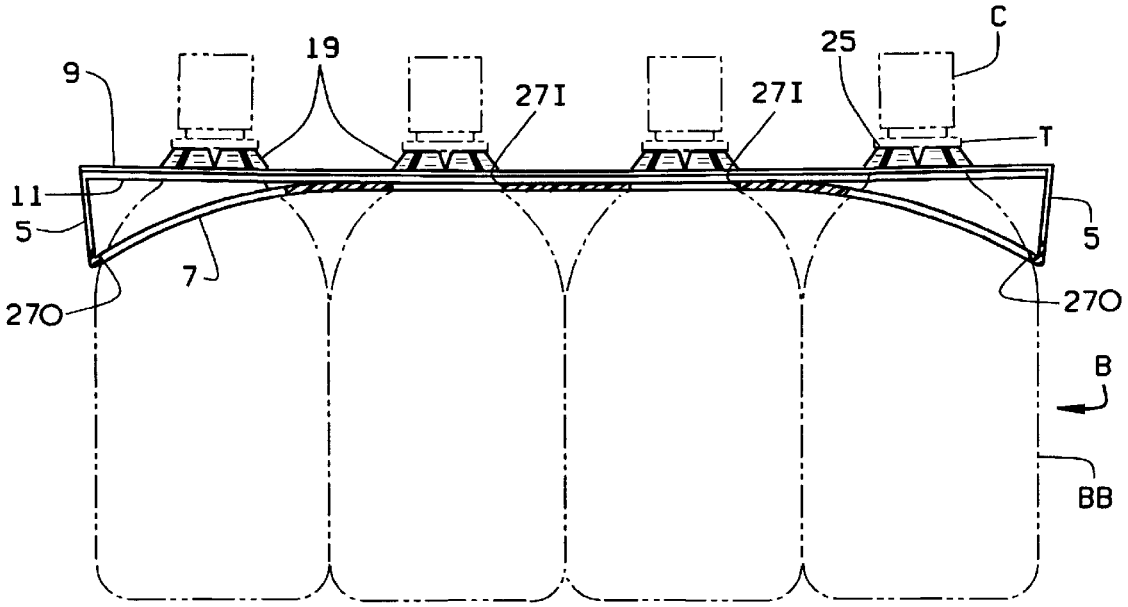
FIG. 2 is a side elevational view of the twelve-pack box-top carrier.
Figure 3:
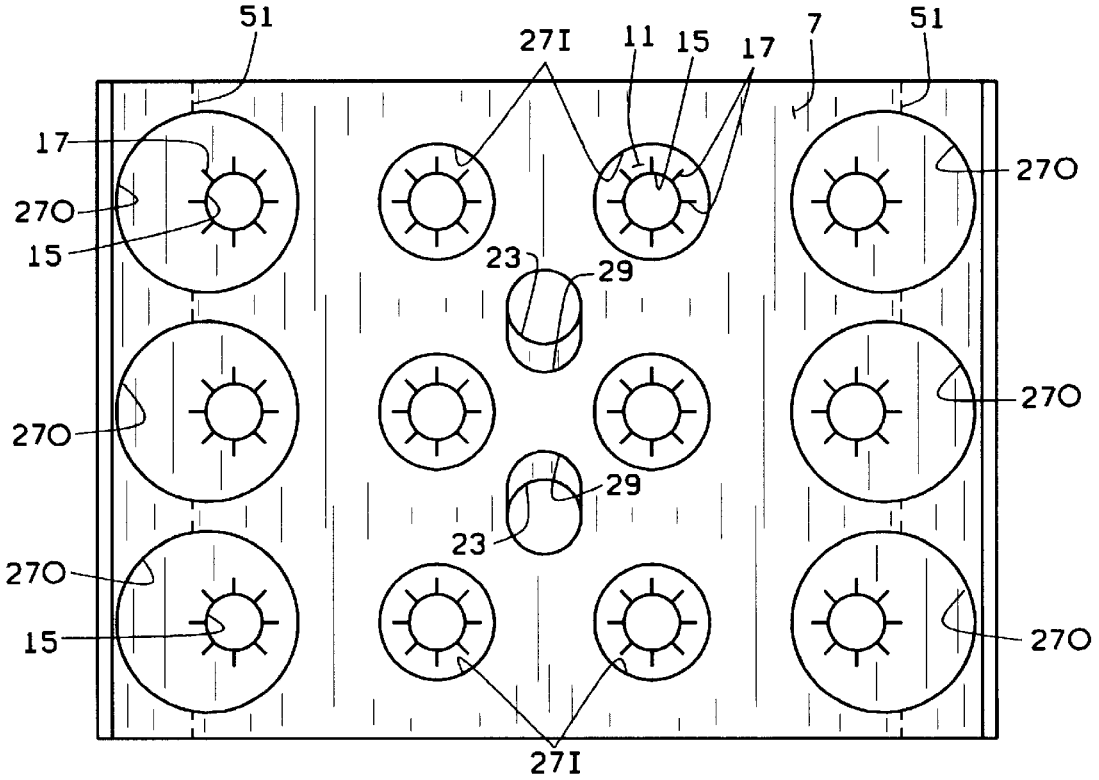
FIG. 3 is a bottom plan view of the twelve-pack box-top carrier, looking upwardly.

A twelve-pack box-top carrier 1 of the present invention is shown in FIGS. 1–3. The carrier 1 may be made of any desired material, but is preferably made of paperboard so that the carrier may be recycled after use. The carrier may be made from virgin or recycled paperboard, or a combination of virgin and recycled paperboard. Preferably, the paperboard is solid unbleached sulfate virgin Kraft paperboard with wet strength, rather than corrugated cardboard, such as is used in Kidd, U.S. Pat. No. 4,850,478. As the need arises, a higher paperboard strength, stiffness, and rigidity can be obtained by increasing the paperboard density, by varying the paperboard formulation, by varying the machining or plying techniques used in producing the paperboard, by using paperboard made according to the Fordranier or other processes, or by using a paperboard in which the plies of the paperboard are laminated together, such that the machine direction of the plies are offset from each other by, for example, 90°. Further, the paperboard can be made from plies of different strengths. The paperboard for the carrier can also be formulated to provide a high wet strength. Brown, as-produced, paperboard can be used for the carrier. However, the paperboard is commonly made white, either by bleaching or coating the Kraft paperboard, to enable the use of quality graphics and to produce an aesthetically pleasing carrier. Other techniques can also be used to whiten brown, as-produced, paperboard. The carrier can also be made from plastic or other materials without departing from the inventive concept.

Conventional bottles B, shown in phantom in FIGS. 1 and 2, are received in the carrier 1. The bottles B each have a body BB, a short neck N extending up from the body, a take-out bead or flange T at the top of the neck N and below the mouth of the bottle, and a closure C which closes the mouth. The take-out bead T forms a chime with the neck of the bottle where the bottom of the take-out bead intersects the neck. Although the invention is described in relation to bottles, such as plastic bottles, it will be understood that the invention is equally applicable to glass bottles and bottles made of other materials, as well as to bottles of other shapes and sizes. Such other bottles may be provided with ribs or grooves and may not include take-out beads.

The carrier 1 (FIGS. 1–3) includes a top panel 3, side panels 5, and a bottom panel 7 which are interconnected to form an open-ended sleeve. Front and/or back panels may be added to close one or both ends of the carrier. The top panel 3 is made of two plies and has a top ply 9 and a bottom or reinforcing ply 11. The two plies are used to provide for positive retention of the bottles, as will be described below, as well as to provide increased planar strength and rigidity for shipping, handling, and carrying packages of containers. Two plies are preferred for the top panel. If more strength is required, the top panel can be made of three or more plies, or the ply width can be varied as strength requires.

The top ply 9 of the carrier has a plurality of surrounding apertures 13. Preferably, the apertures 13 are evenly spaced about the top ply. In the carrier 1, twelve apertures are formed in the top panel in a 4×3 array. The array of apertures thus includes two rows O of outboard apertures adjacent the sides 5 of the carrier 1 and two rows I of inboard apertures between the rows of outboard apertures.

The reinforcing ply 11 has a plurality of container receiving apertures 15 which have a diameter slightly smaller than the diameter of the bottle where the bottle is engaged by the apertures 15. Preferably, the apertures 15 engage the bottle along the bottle's neck N at a point below the bottle's take-out bead T. A plurality of slits 17 radiate outwardly from the container receiving apertures 15 to define fingers or tabs 19. (FIGS. 1 and 2) The container receiving apertures 15 are positioned to be concentric with the surrounding apertures 13 in the top ply 7. The surrounding apertures 13 have a diameter sized to be about equal to the diameter of a circle defined by the radially outermost end of the slits 17. The edge of the surrounding aperture 13 thus defines a folding point for the tabs 19. The scoring or embossing typically used to define the fold line for the tab therefore is not necessary. The elimination of this fold line in our carrier maintains the structural integrity of the carrier in its tabs and reduces the carrier's susceptibility or vulnerability to weakening by the absorption of moisture. The carrier 1 is also provided with finger holes 23 which pass through both plies of the top panel 3 so that a consumer can easily pick up and carry the multi-pack carrier 1.

When the bottles are placed in the carrier, the tabs 19 engage the bottom of the take-out bead T of the bottle, as seen in FIG. 2. The tabs 19 are of a length, such that they form an angle, preferably, of about 60° with the top ply 9 when the bottle is in the carrier and the tip 25 of the tab is engaged with the bottle's take-out bead T. If the angle is much greater than 60° (i.e., more than about 75°), the tabs 19 will be too vertical and will lessen the ability of the tab 19 to engage the take-out bead T. If the angle is much less than 60° (i.e., less than about 45°), the tabs 19 will be too horizontal and will tend to collapse, not having enough vertical strength to hold the bottles B in the carrier. At present, the use of virgin Kraft paperboard for the carrier yields sufficient strength and rigidity for the tabs 19 without the need to consider cross- or machine-direction weaknesses.

The tabs 19 are formed from the container receiving apertures 15, and thus have an inner edge which defines an arc of the circle of the container receiving aperture. Due to the arc of the tab edge, the tabs 19 will not contact the bottle take-out bead T along 100% of their edges. Rather, the contact of the each tab 19 against the take-out bead T will be at a pair of points. Despite this, the use of circular container receiving apertures are preferred. However, the container receiving apertures, and hence the tabs 19, can be formed so as to obtain 100% contact of the tabs with the bottle take-out bead.

The number of slits 17 formed around the container receiving apertures 15 depends on the diameter of the container receiving apertures 15 to prevent the tabs from being too narrow or too broad. If the tabs are too broad, there will be insufficient contact of the tip or radially innermost edge 25 of the tab 19 with the take-out bead T and the bottle will not be adequately supported by the tabs 19 in the carrier. When a round hole is used, we have found that a tab with a side-to-side width of about 0.25" to 0.35" at the tip 25 of the tab (i.e. at the radially innermost edge of the tab) works well. To maintain this dimension, we have found that it is preferable to provide eight tabs when the container receiving aperture 15 has a diameter of 0.625" to 0.875"; for diameters between 0.875" and 1.375", there are preferably twelve (12) tabs; and; for diameters between 1.375" and 1.875", there are preferably sixteen (16) tabs. As the diameter of the container receiving apertures 15 become greater than 1.875", the number of tabs 19 will have to be properly increased. As noted above, the tabs are sufficiently long to form an angle of about 45° to about 75° with the carrier top panel, and preferably about 60° with the carrier top panel 5 when the tab engages the take-out bead T of the bottle. This preferred tab size (i.e., length and width) provides for a tab which will clear the diameter of the take-out bead T when the bottle is passed through the aperture, yet will allow the tab to be resilient, such that the tab will spring back to engage the take-out bead T of the bottle B.

The tabs 19 engage the bottom of the take-out bead T. Because the caps on plastic or PET bottles are screw-on caps, the tabs 19 can engage the bottom of the cap, rather than the take-out bead, without fear of impairing a seal of the bottle. Some molded bottles or containers are provided with circumferential ribs or grooves. These are often placed on the bottle to facilitate gripping of the bottle by a customer, or just for aesthetic purposes. The tabs, alternatively, can engage these ribs or grooves to hold the bottle in the carrier. However, it is preferred that the tabs engage the take-out bead or flange, when one is provided.

The bottom panel 7 has four rows of apertures which allow the box-top carrier 1 to be applied to a group of bottles. The bottom panel apertures are divided into two sets of apertures—there are two rows of outboard apertures 27O and two rows of inboard apertures 27I. The bottom panel apertures 27O,I are aligned with the apertures 13 and 15 in the top panel 3 so that a bottle B can be passed through the apertures. The inboard apertures 27I are preferably substantially coaxial with the inboard rows I of apertures in the top panel. The outboard apertures 27O, however, are radially offset from the outboard apertures O in the top panel 3. Thus, the center of the bottom panel apertures 27O are closer to the side panels 5 then the centers of the outboard apertures 13O of the top panel. Also the bottom panel outboard apertures 27O are larger than the inboard apertures 27I. In the present design, the bottom panel 7 comes into contact with the top panel 3 when the carrier is applied to a group of bottles. Thus, the bottom panel 7 is provided with holes 29 which are positioned to be concentric with the finger holes 23 in the top panel 3. The holes 29 are elongate to avoid the bottom panel 7 from being grasped by a consumer when the carrier is lifted. Thus, the carrier will be lifted by the top panel only. If desired, however, the bottom panel holes 25 can be sized so that the carrier will be lifted by both the top and bottom panels.

As seen in FIG. 2, the bottom panel inboard apertures 27I are sized, such that when bottles are received in the carrier 1, the bottles come into contact with the edges of the inboard apertures 27I. The bottom panel outboard apertures 27O are sized and positioned in the bottom panel, such that when bottles are placed in the carrier, the outboard edges of the apertures 27O engage a surface of the bottle B. The apertures 27O,I are shown to be circular, but could be other shapes as well. For example, the apertures could be oval, oblong, or irregularly shaped. With respect to the shape of the bottom panel outboard apertures 27O, what is important is that they conform generally to the surface of the bottle which is engaged by the individual apertures, so that there is a contact of the aperture with the bottle at an outboard position and preferably also at an inboard position. This allows for the engagement of the outboard apertures 27O with the bottle at at least two points, the two points being in two different planes or elevations relative to the bottle. Further, adjacent inboard apertures 27I could be replaced with ovals, such that there would be one row of three ovals rather than two rows of three circles.

Figure 6:
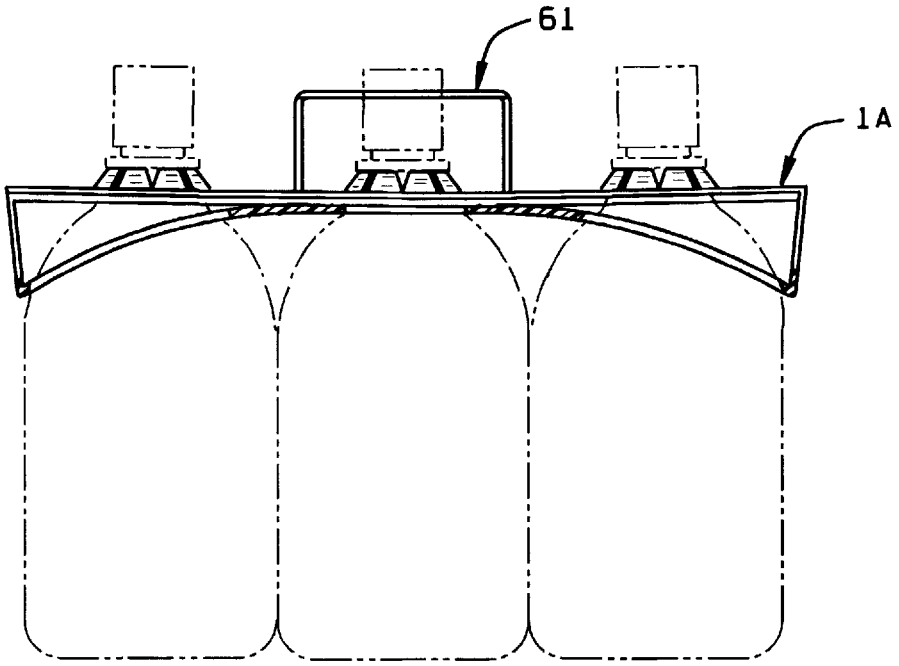
Figure 7:
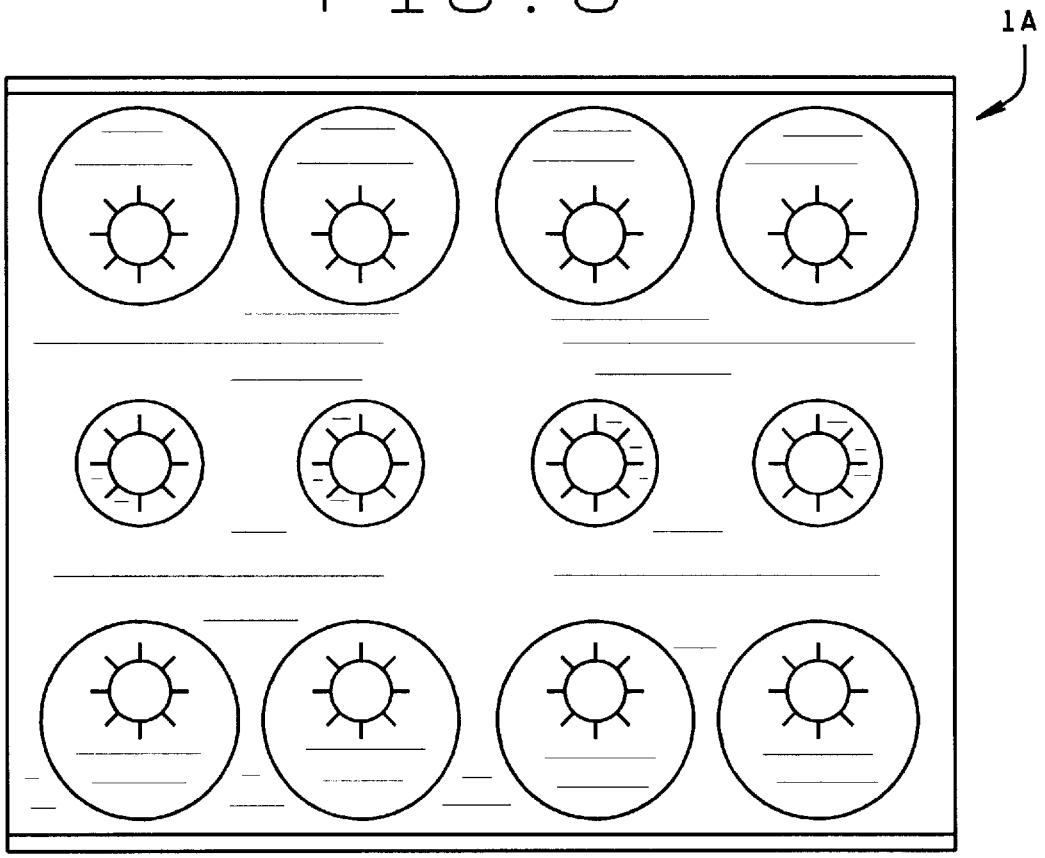
Figure 8:
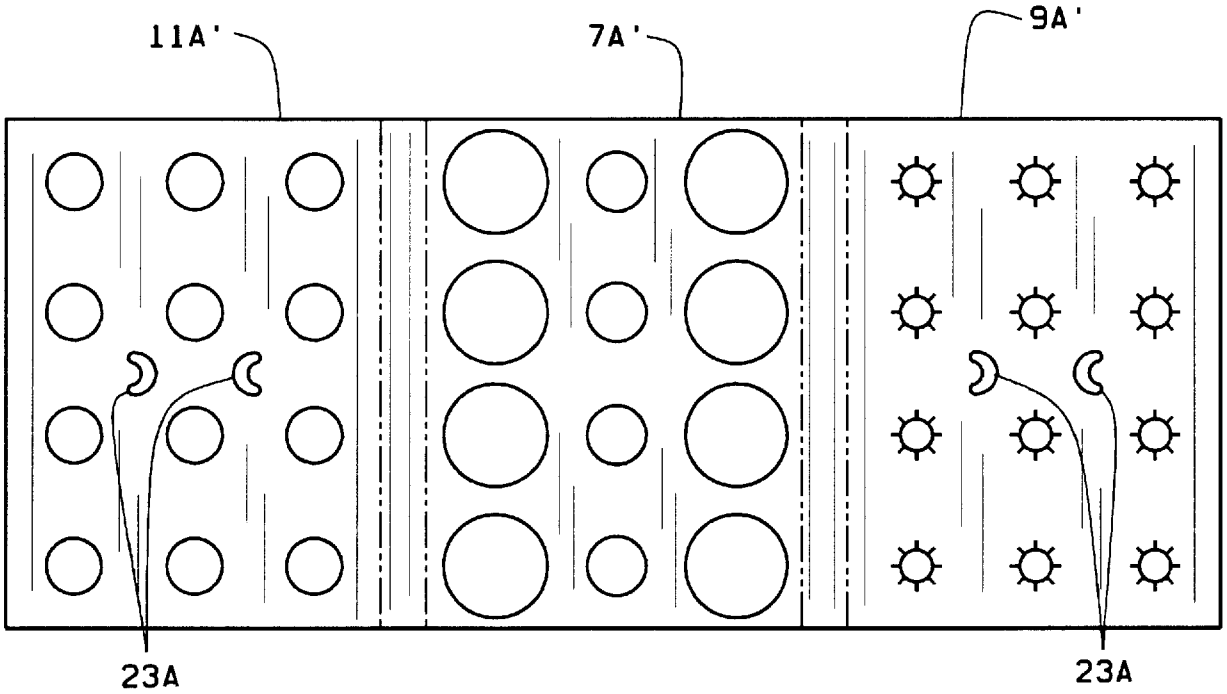

The carrier blank 31 (FIG. 4) from which carrier 1 is made is preferably a one-piece blank made from a single piece of material. As discussed in our U.S. Pat. No. 5,590,776, the top panels of the carrier 1 can be made more rigid by adding a third ply. This third ply can be incorporated into the blank from which the carrier is made, or can be formed from a second blank. The blank 31 has two end sections 9' and 11' which form the top and second plies 9 and 11 (FIG. 6), respectively, of the top panel 3. Blank sections 5' are hingedly connected to sections 9' and 11', respectively, and form side panels 5 of the carrier 1. The sections 5' are separated from the sections 9' and 11' by fold lines 41 and 43. A center section 7' is hingedly connected to the sections 5' along fold lines 47 and 49 to define the bottom panel 7 of the carrier 1.

The carrier blank 31 is preferably die-cut in a single step. As can be seen, the blank is linear or quadrilateral. The blanks therefore can be formed with a minimum amount of waste. The blanks 31 are folded into carriers 1 using standard folding equipment. In the folding or forming process, the two end sections 9' and 11' are glued, bonded, or otherwise connected together to ensure that the blank is folded into, and remains, a sleeve. Other methods could be used to secure the two sections 9' and 11', e.g. they could be stapled or tab locked together.

The carrier 1, when formed, can be flattened so that the blank can be shipped easily in bulk. At a packaging plant, the flattened carriers are easily erected to their opened form, and can be easily applied to a group of bottles to form a package.

To apply the carrier 1 to a group of bottles B, the bottles are initially grouped into an array of the appropriate number of bottles. The carrier is then taken from its flattened state and formed or opened into a sleeve. The carrier is then simply applied, either manually or by machine, over the tops of the bottles, so that the bottle caps will be forced through the container receiving apertures 15 to urge the tabs 19 upwardly until the bottle's take-out bead or flange T (or other point of engagement) is engaged by the ends 25 of the tabs 19. As described above, the edge of the surrounding aperture 13 will form the fold line of the tabs 19. The tabs 19 will thus all fold or bend at the desired point, so that they will all be of the desired size. Because there is no fold line in the lower ply 11 to define the ends of the tabs 19, the surrounding apertures 13 maintain the tab stability at the tab base and help prevent elongation of the slits 17 in the top panel lower ply 11 as carrier 1 is applied over the bottles B.

The design of the carrier allows for the carrier to be applied to bottles individually or in groups. Further, the carrier can be applied to bottles while they are in their shipping cases. When the carriers are being applied to the bottles manually, a first carrier 1 is applied to twelve bottles of a twenty-four bottle case while the bottles are still in the case. A second 12-pack carrier 1 is then applied to the remaining twelve bottles in the case, again, while the bottles are still in the case. When the carriers are being applied automatically (i.e., by machine rather than by hand) two twelve pack carriers can be applied simultaneously to the twenty-four bottles in a case, while the bottles are in the shipping case.

As seen best in FIG. 3, the bottom panel apertures 27O,I are smaller than the bottle's diameter, at the point of the bottle where the bottom panel apertures 27O,I surround the bottle. The side panels 5 are of a length, such that when the carrier is applied to the bottles, the top panel 3 will become slightly downwardly arched and the bottom panel 7 will become upwardly arched. The arch in the bottom panel 7 is sufficient to bring the bottom panel 7 into contact with the top panel 3. This brings the outboard edges of the outboard apertures 27O (i.e. the edges of the aperture closer to the carrier sides 5) in the bottom panel 7 into tighter contact with the outer surfaces of the bottle. When the carrier (with the bottles) is lifted, the contact between the outboard apertures 27O and the bottles B increases, causing the bottles to draw inwardly to bring the bottles toward each other. The bottles are thus bound together in the carrier. The carrier could be designed such that the top and bottom panels do not contact each other by increasing the diameter of the bottom panel apertures and/or by increasing the height of the side panels. If the bottles have long necks, the diameter of the bottom panel apertures may not need to be increased.

Figure 4:
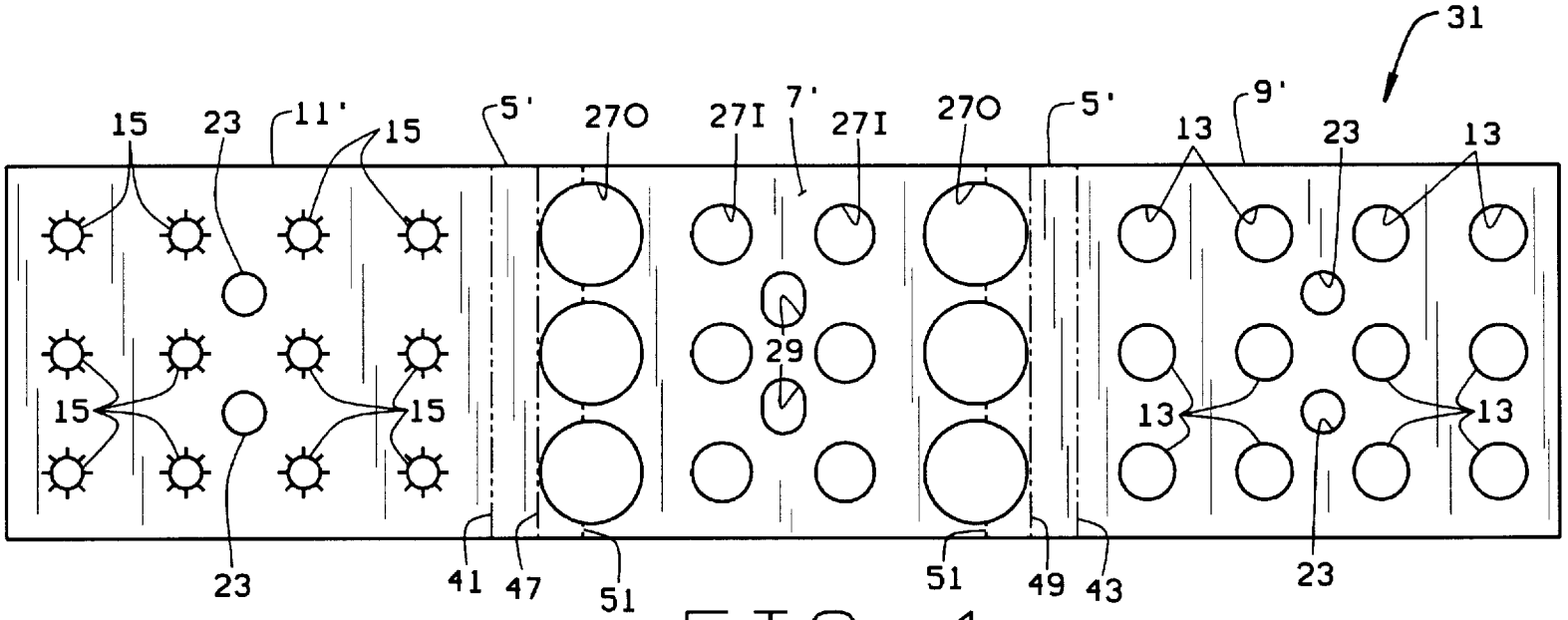
FIG. 4 is a plan view of a blank used to form the twelve-pack box carrier.
Figure 5:
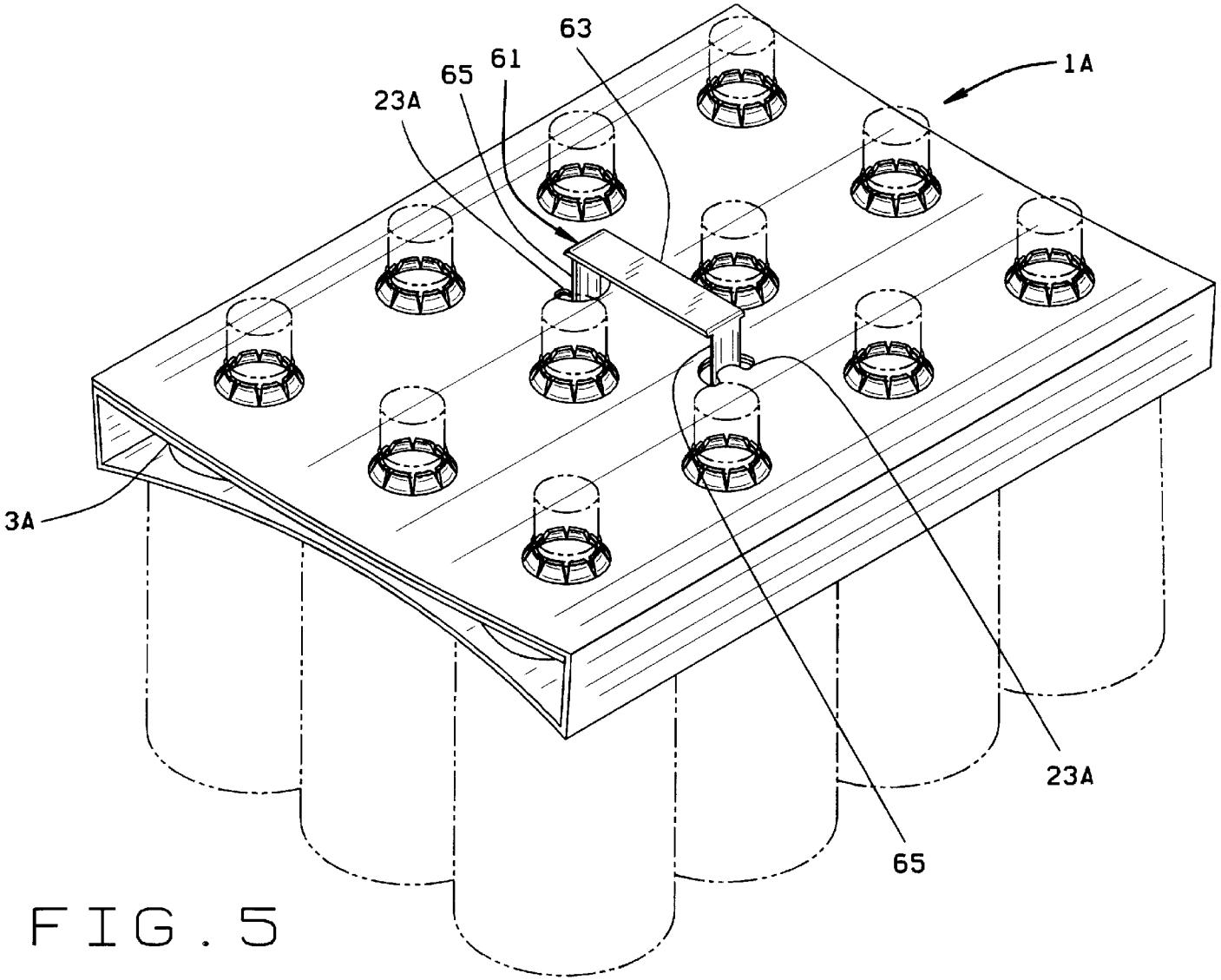
FIGS. 5–8 are a perspective, side elevational, bottom plan and top plan views of an alternative twelve-pack box-top carrier having a flexible handle.

As best seen in FIG. 4, the bottom panel 7 is substantially equal in length to the top panel plies 9 and 11. Thus, when the carrier is opened and squared, prior to receiving bottles, it is generally rectangular in end elevation. However, due to the size of the side panels 5, and the offset position of the bottom panel outboard apertures 27O relative to the apertures in the outboard rows O of the top panel 3, the side panels 5 will slope downwardly and inwardly, as seen in FIG. 2, when the carrier is applied to a group of bottles. This inward slope of the side walls increases the contact of the bottom panel apertures 27O with the bottles B when the carrier 1 with bottles is lifted.

When the multi-pack carrier 1, with bottles B therein, is lifted, the outer edge of the apertures 27O will contact the bottles more forcibly. When the carrier 1 is lifted, the top panel 3 flattens or becomes more planar and pushes the side panels further downwardly, relative to the bottles, causing the bottom panel 7 to arch upwardly even more. Because the arched aspect of the bottom panel facilitates binding together of the bottles, the bottom panel preferably is made from a single section, and thus has a continuous, uninterrupted side edge extending between the two side panels 5. The bottom panel apertures 27O,I, and hence the top panel apertures 13 and 15, are positioned on the carrier such that the bodies of the bottles will contact the bodies of neighboring bottles, when the carrier is applied to the bottles. This contact is increased when the carrier, with the bottles, is lifted to increase the binding effect of the carrier on the bottles. Because the bottles are in contact with each other, when the carrier is lifted, the bottles will not be able to swing relative to each other. This will further aid in preventing the bottles from moving relative to each other and in preventing impacts between the bottles.

The mechanics of the carrier urge the outboard rows of bottles inwardly towards the inboard row of bottles such that the bottle bodies move toward each other slightly. This slight motion of the of the bottles towards each other will increase the binding effect of the carrier on the bottles. As noted above, this binding effect is increased when the carrier, with bottles, is lifted.

Because the arch in the bottom panel is fairly pronounced, a fold line or break line can form in the bottom panel 7 when the arch is induced in the panel. The break-line, if it forms by itself, is not controllable, and it can detract from the aesthetic appearance of the carrier. Thus, to control where and how the fold forms, a break-line 51 (FIG. 3) can be embossed, or otherwise formed, in the bottom panel 7. This break-line is preferably formed where the natural break-line is anticipated to be formed and runs generally parallel to the side panels 5.

Turning to FIGS. 5–11, an alternate twelve-pack carrier 1A is shown. Carrier 1A is substantially similar to the carrier 1 of FIGS. 1–4. However, rather than having four rows of apertures across the arched direction of the bottom panel, the carrier 1A has three rows of apertures extending across the arched direction of the bottom panel. The carrier 1A thus has a 3×4 array, rather than a 4×3 array, of apertures in the top and bottom panels. This gives the carrier two outboard rows of apertures and a single inboard row of apertures. By reducing the number of inboard apertures, the carrier is made sturdier.

The carrier 1A is provided with a flexible handle 61 which is received in handle holes 23A in the top panel. Because the handle 61 is provided, the finger holes are omitted from this carrier. The handle holes 23A are preferably generally crescent or "U" shaped, but with rounded, rather than pointed ends, and are positioned such that the two handle holes 23A face away from each other. That is, the crescents open away from each other. With minor modifications to the handle heads, the hole 23A can be replaced with a slit through which the handle can slide. Alternatively, the hole 23A can be T-shaped, oval, or key-hole shaped. Further, the direction of the holes 23A can be inverted, such that the crescent shaped holes face each other, rather than away from each other.

Figure 9:
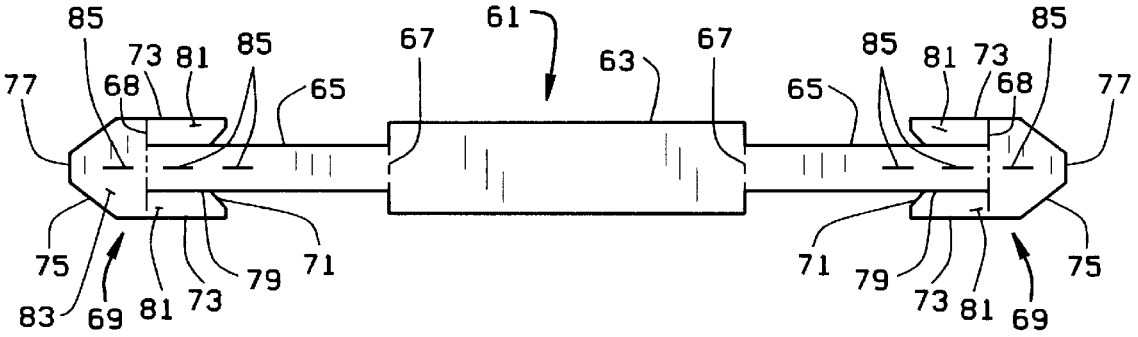
FIG. 9 is a plan view of the handle.
Figure 10:
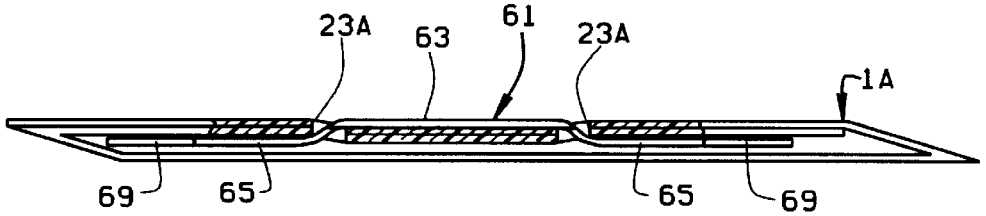
FIG. 10 is a cross-sectional view of the carrier with the handle therein, the carrier being in a flat state, and the handle lying flat in the carrier.
Figure 11:
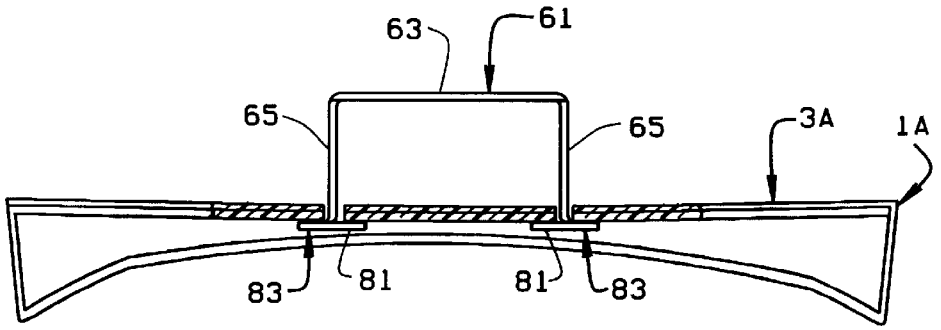
FIG. 11 is a cross-sectional view of the carrier with the handle, but with the carrier opened and the handle shown in a carrying position.
Figure 12:
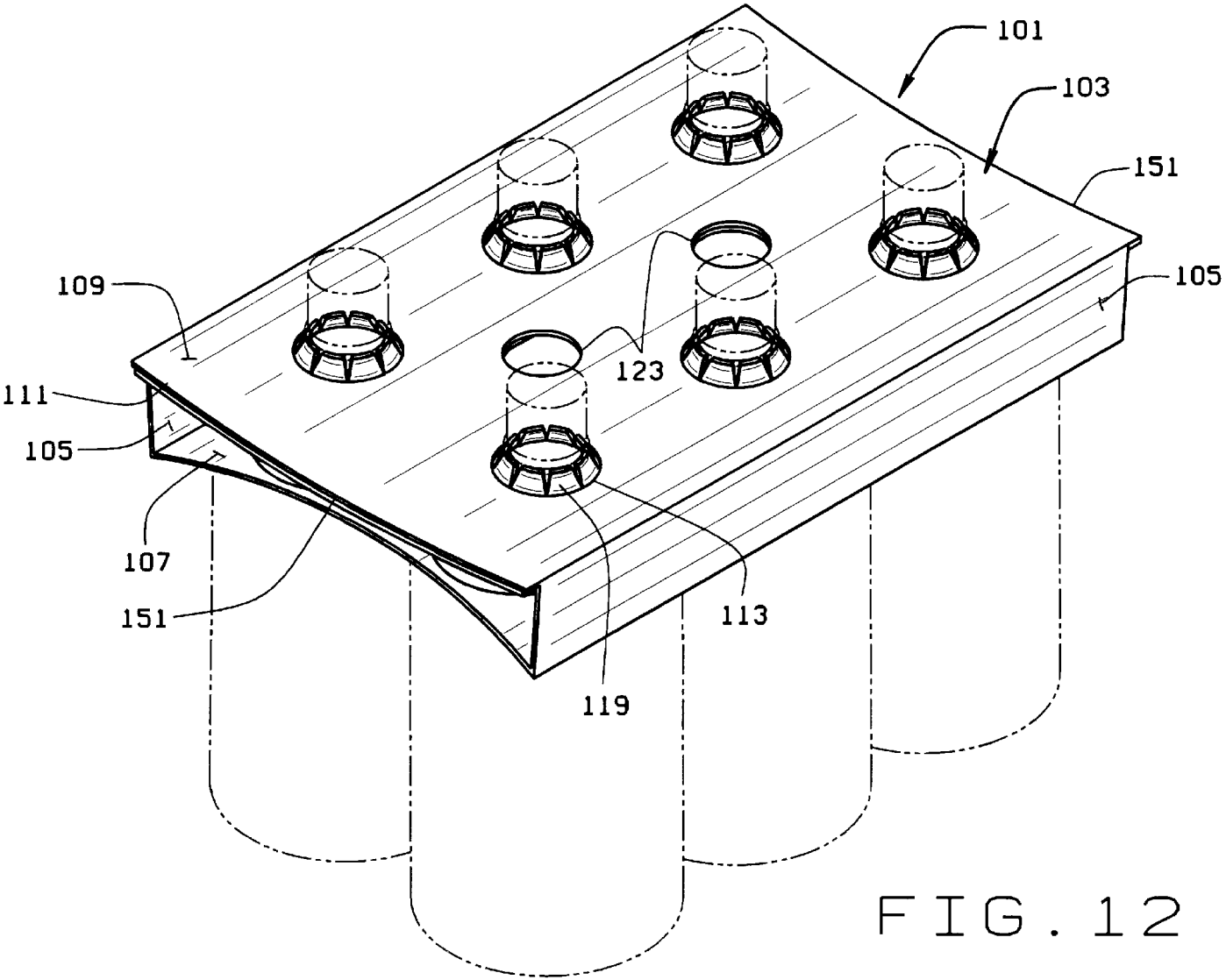
FIGS. 12–15 are a perspective, side elevational, bottom plan and top plan views of an six-pack box-top carrier.
Figure 14:
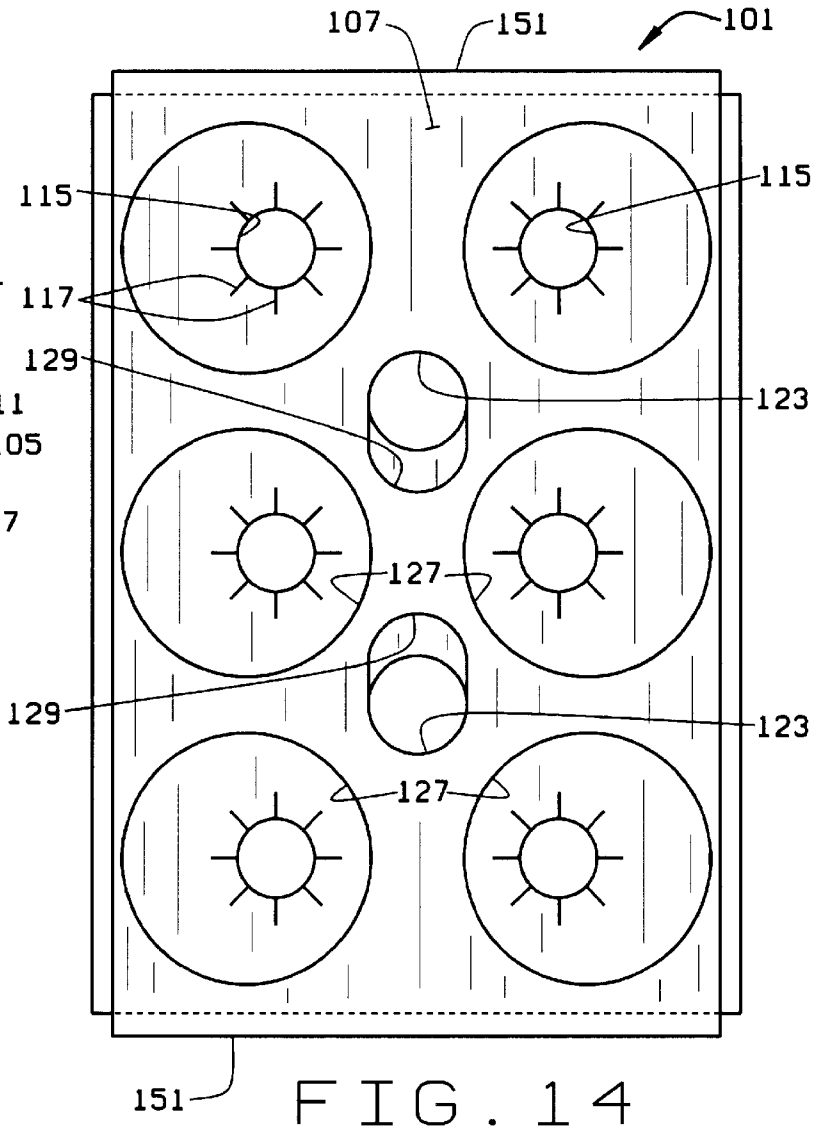
Figure 13:
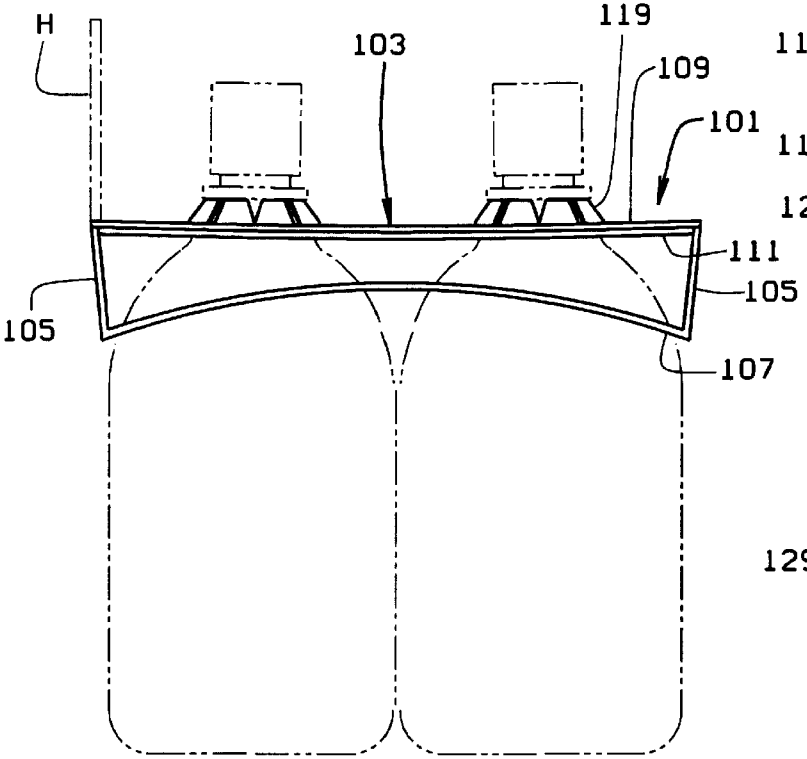
Figure 15:
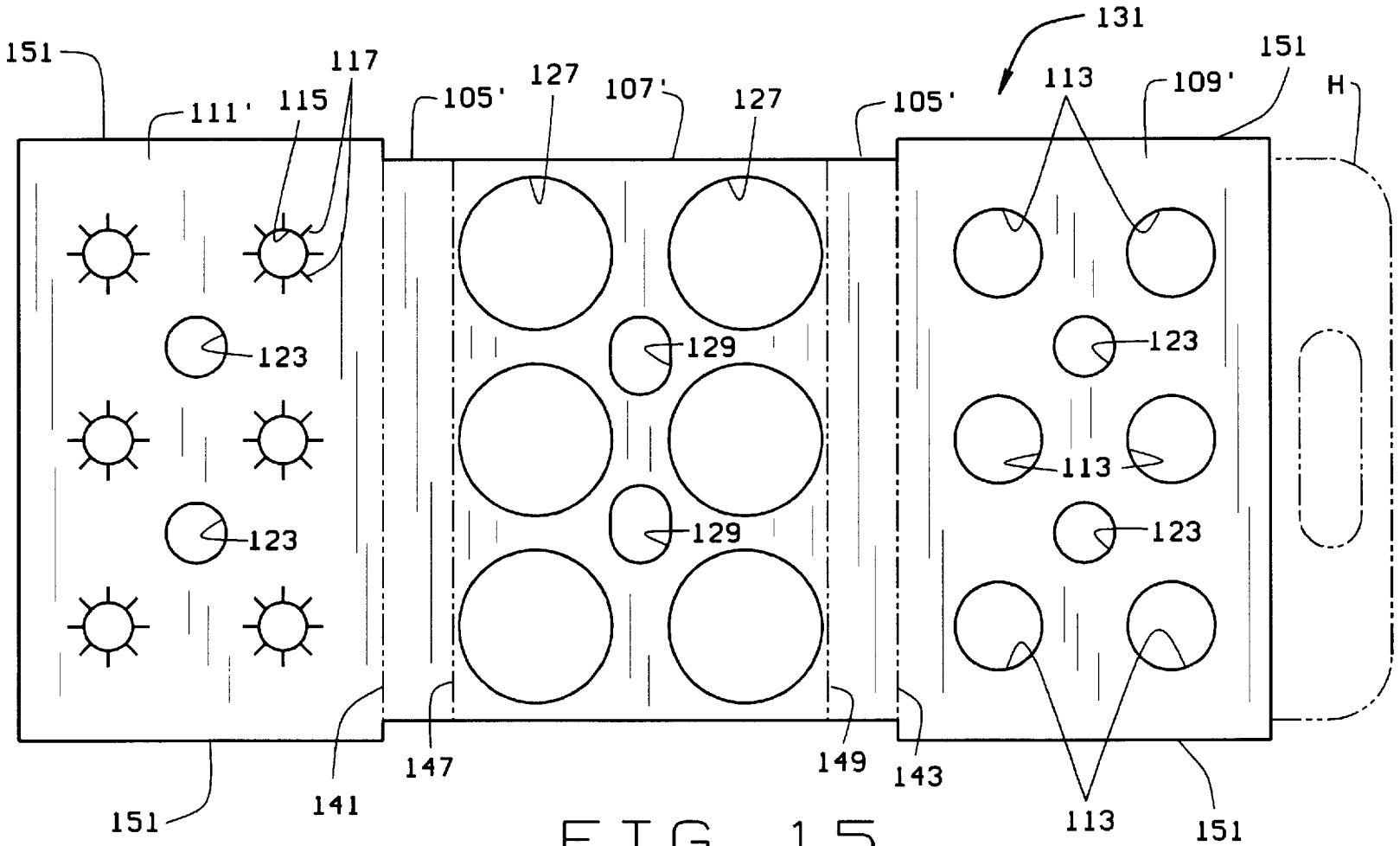
Figure 17:
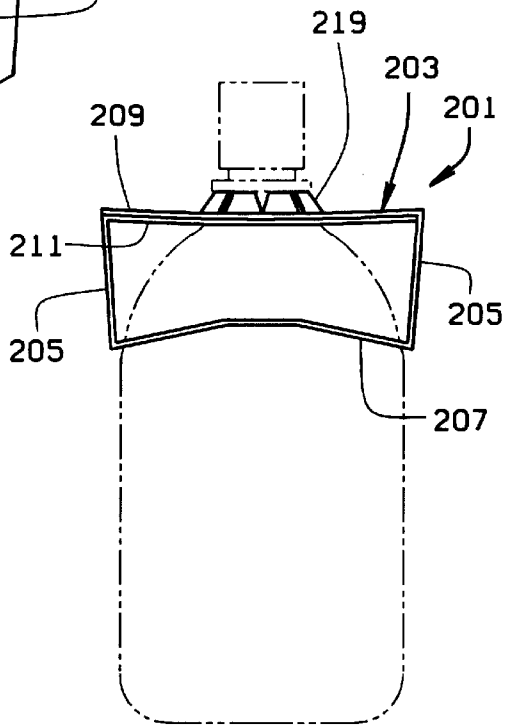
FIGS. 16–19 are a perspective, side elevational, bottom plan and top plan views of a three-pack box-top carrier.
Figure 16:
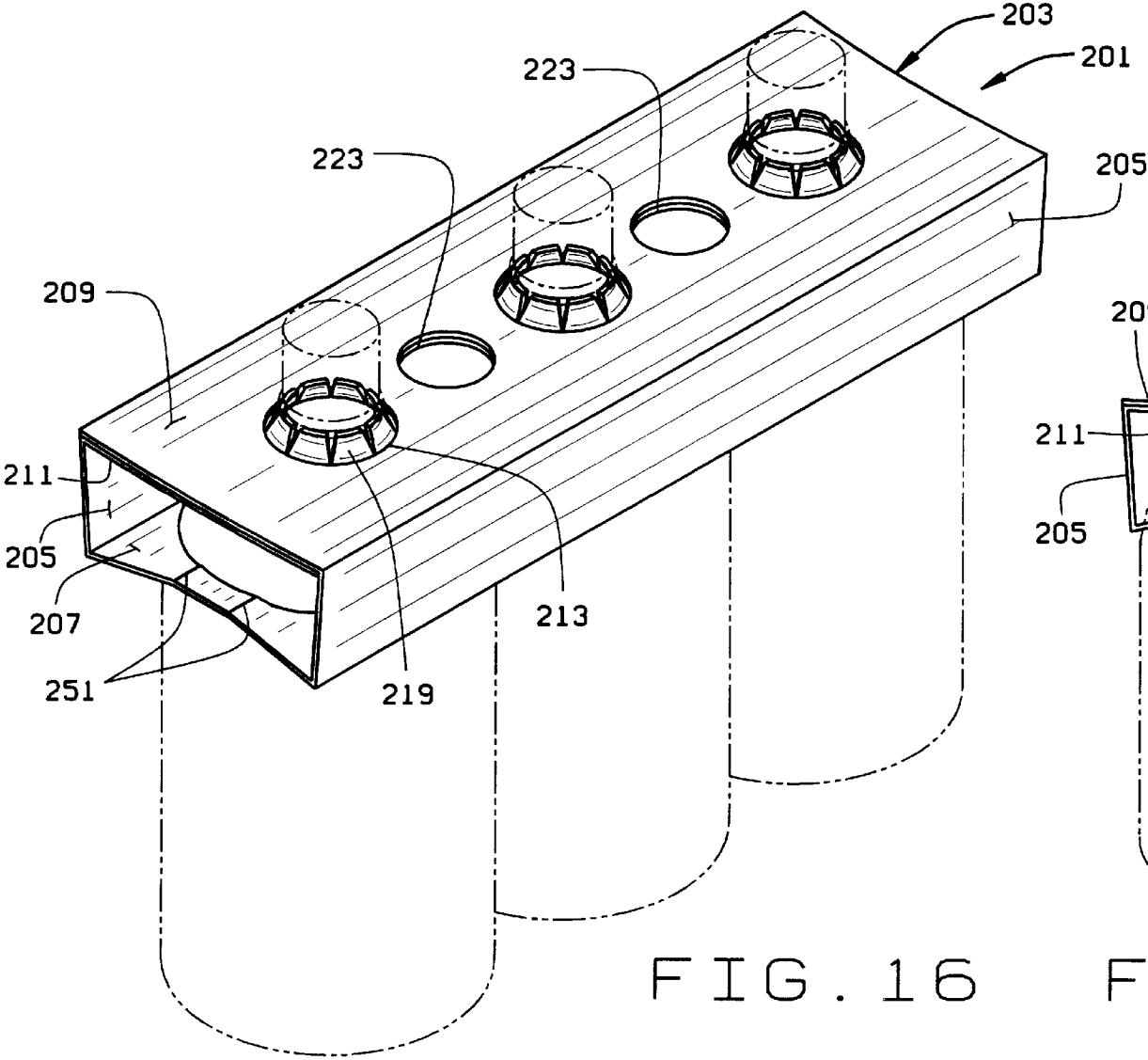
Figure 19:
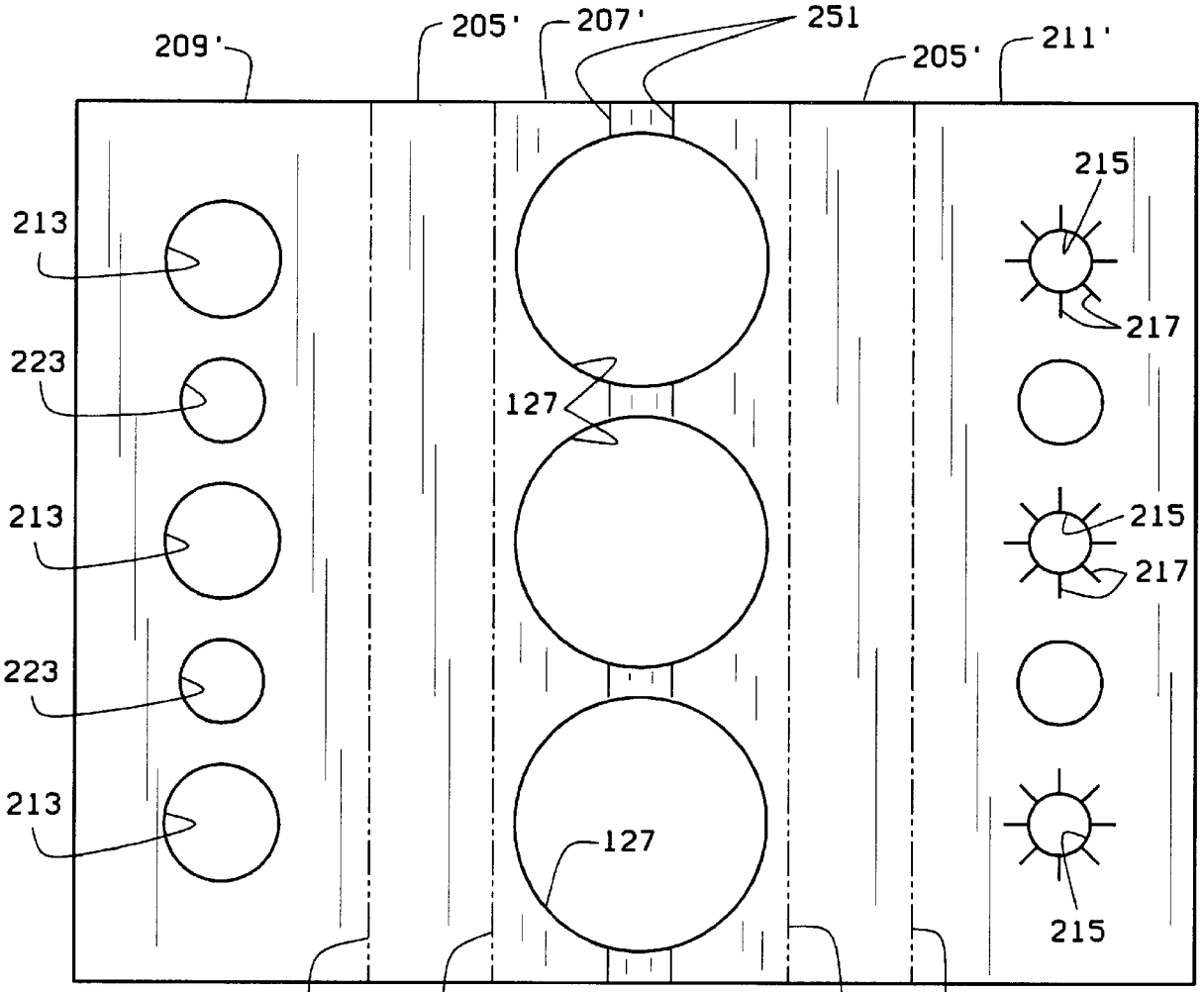
Figure 18:
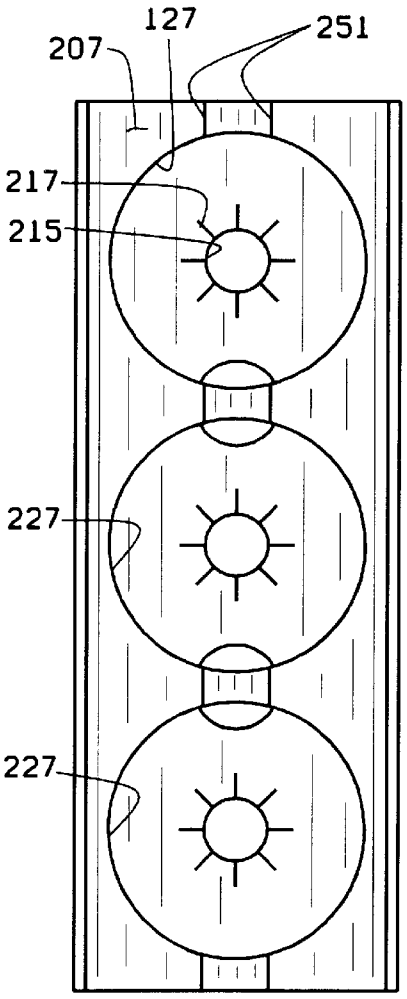

The handle 61 is shown in plan in FIG. 9. The handle 61 includes a center section or body 63 which is grasped by the consumer. The center section 63 preferably has a length no longer than the distance between the two handle holes 23A so that the handle may lie flat when applied to the carrier for bulk shipping of the carrier, as seen in FIG. 10. A neck 65 extends from each end of the body 63. The necks 65 are narrower in width than the body 63 and can be separated from the body by a fold line 67. A head 69 is formed at the end of each neck 65, and is separated from the head by a fold line 68. The head 69 preferably has rearwardly beveled back edges 71 and sides 73. The sides 73 are generally parallel to the body 63 and neck 65. The front of the head 69 is comprised of edges 75 that slope inwardly from the front of the side edges 73 and a flat front edge 77 which extends between the front ends of the edges 75.

A pair of slits 79 extend rearwardly from the fold line 68 to form barbs 81 adjacent the neck 65. The barbs can flex away from the body 83 of the head 69 along the fold lines 68. The outer corners of the barbs are blunted to eliminate the point which would otherwise be formed from the slope of the back edges 71 of the handle heads 69. A series of relief slits 85 are formed in the head 69 and at the end of the neck 65 to enable the head to be bent around its longitudinal axis to facilitate insertion of the handle 61 in the carrier 1A. The slits 85 (which can be replaced with a fold line, or other equivalent structure) preferably extends along the longitudinal axis or center of the head 69.

To insert the handle 61 into the carrier 1A, the heads 69 are bent about the slits 81 and inserted into the handle holes 23A. The holes 23A have a diameter or largest dimension that is less than the width of the head 61 between the side edges 73. Preferably, the diameter or largest dimension of the holes 23A is between the width of the neck 65 and the distance between the back ends of the slits 79. Once the heads 69 are inserted into the holes 23A, the necks 65 of the handle will follow. The necks 65 and heads 69 are sized such that they can lie flat when inserted into the carrier. (FIG. 10) Thus, the distance from the back of the neck 65 to the front edge 77 of the head 69 is no greater than the distance between the hole 23A and the side panel of the carrier.

When a consumer picks up a package of bottles in the carrier 1A, the consumer simply pulls up on the handle body 63. As the handle is pulled up, the handle necks 65 will be pulled through the openings 23A. As the heads 69 are pulled towards the holes 23A, the barbs 81 of each head will separate from the head bodies 83 or bend relative to the head body 83. Thus, as the head bodies 83 begins to bend, the barbs 81 will remain generally straight. The barbs 81 will thus catch on the underside of the top panel 3A to prevent the head 61 from being pulled through the openings completely. (FIG. 11) When the package is lifted, the handle 61 can bend at the fold line 67 to form a rectangular or square shaped handle. That is, the transition from the necks 65 to the body 63 will be defined by a sharper angle and less of a curve.

As shown in FIG. 10, the handle lies flat between the bottles prior to being raised to its carrying position. Thus, the handle 61 does not interfere with the application of the carrier to a group of bottles. Further, because the handle 61 is flexible, it will not interfere the stacking of packages of bottles, even when the handle is in a raised position. If the handle is raised, by a stocker, for example, a package can be placed atop the package with the raised handle. The handle of the lower package will simply bend or flex, and allow the upper package to sit atop the lower package.

Turning to FIGS. 12–15, a carrier 101 for a six-pack is shown. The carrier 101 is substantially similar (except for the number of bottles carrier) to the twelve-pack carrier 1 of FIGS. 1–4. The carrier 101 includes a top panel 103, side panels 105, and a bottom panel 107 which are interconnected to form an open-ended sleeve. The top panel 103 is made of two plies and has a top ply 109 and a bottom or reinforcing ply 111.

The top ply 109 of the carrier has a plurality of surrounding apertures 113 which are evenly spaced about the top ply. In the carrier 101, six apertures are formed in the top panel in a 2×3 array. The reinforcing ply 111 has a plurality of container receiving apertures 115 which have a diameter slightly smaller than the diameter of the bottle's neck N at a point below the bottle's take-out bead T. A plurality of slits 117 radiate outwardly from the container receiving apertures 115 to define fingers or tabs 119. The container receiving apertures 115 are positioned to be concentric with the surrounding apertures 113 in the top ply 109. The surrounding apertures 113 have a diameter sized to be substantially equal to, or slightly less than, the diameter of a circle defined by the radially outermost end of the slits 117. The edge of the surrounding aperture 113 thus defines a folding point for the tabs 119. The carrier 101 is also provided with finger holes 123 which pass through both plies of the top panel 103 so that a consumer can easily pick up and carry the multi-pack carrier 1.

The bottom panel 107 has two rows of apertures 127 which allow the box-top carrier 101 to be applied over the bottles. The bottom panel apertures 127 are aligned with the apertures 113 and 115 in the top panel 103 so that a bottle B can be passed through the apertures. However, they are radially offset from the apertures 113 and 115 in the top panel 103. Thus, the center of the bottom panel apertures 127 are closer to the side panels 105 than are the apertures in the top panel 103. Because the bottom panel 107 comes close to the top panel 103 when bottles are placed in the carrier, the bottom panel 107 is preferably provided with elongate holes 129 which are positioned to be in line with the finger holes 123 in the top panel 103. The provision of the elongate holes 129, rather than round holes, will prevent the bottom panel from being grabbed when a consumer lifts the carrier.

The carrier blank 131 (FIG. 15) from which carrier 101 which is made is preferably a one-piece blank made from a single piece of material. The blank 131 has two end sections 109' and 111' which form the top and second plies 109 and 111, respectively, of the top panel 103. Blank sections 105' are hingedly connected to sections 109' and 111', respectively, and form the side panels 105 of the carrier 101. The sections 105' are separated from the sections 109' and 11' by fold lines 141 and 143. A center section 107' is hingedly connected to the sections 105' along fold lines 147 and 149 to define the bottom panel 107 of the carrier 101.

If desired, the carrier 101 can be provided with a handle H which extends upwardly from the top panel 103. The handle H, in the blank 131, is hingedly connected to the top ply forming portion 109'. The carrier 101 can also be provided with a break-line in the bottom panel, in the same manner that the carrier 1 is provided with the break-line 51.

The bottom panel apertures 127 are slightly smaller than the bottle's diameter, at the point of the bottle where the bottom panel apertures 127 surround the bottles. The side panels 105 are of a length, such that when the carrier is applied to the bottles, the top panel 103 will become slightly downwardly arched and the bottom panel 107 will become upwardly arched. The arch in the bottom panel 107 is sufficient to bring the bottom panel 107 close to the top panel 103. Although the top and bottom panels do not contact each other in the carrier 101 as they do in the carrier 1 (FIG. 1), the distance between the top and bottom panels is sufficiently close that the bottom panel 107 is preferably provided with elongate holes 129. The bottom panel holes 129 are positioned to be in line with the top panel finger holes 123 when bottles are received in the carrier. Again, this will prevent the bottom panel from being grabbed when the carrier is lifted by a consumer.

The arching of the bottom panel brings the outer edges of the bottom panel apertures 127 (i.e. the edges of the aperture closer to the carrier sides 105) into tighter contact with the outer surfaces of the bottles. When the carrier (with the bottles) is lifted, the contact between the apertures 127 and the bottles B increases, causing the bottles to draw or move inwardly to bring the bottles toward each other.

The bottom panel 107 is substantially equal in length to the top panel plies 109 and 111. Thus, when the carrier is opened and squared, prior to receiving bottles, it is generally rectangular in end elevation. However, due to the size of the side panels 105, and the offset position of the bottom panel apertures 127 relative to the apertures in the top panel 103, the side panels 105 will slope downwardly and inwardly when bottles are placed in the carrier. This inward slope of the side walls will help to increase the contact of the bottom panel apertures 127 with the bottles B when the carrier with bottles is lifted.

When the multi-pack carrier 101, with bottles B therein, is lifted, the outer edge of the bottom panel apertures 127 will contact the bottles more forcibly. When the carrier 101 is lifted, the top panel 103 flattens or becomes more planar and pushes the side panels further downwardly, relative to the bottles, causing the bottom panel 107 to arch upwardly even more. Because the arched aspect of the bottom panel facilitates preventing the swinging of bottles, the bottom panel preferably is made from a single section, and thus has a continuous, uninterrupted side edge extending between the two side panels 105. The bottom panel apertures 127, and hence the top panel apertures 113 and 115, are positioned on the carrier such that the bodies of the bottles will forcibly contact the bodies of neighboring bottles, when the carrier is lifted. This will increase the binding effect the carrier exerts on the bottles. Because the bottles are in contact with each other, when the carrier is lifted, the bottles will not be able to swing relative to each other.

If desired, the carrier can be provided with tabs, lips, or extensions 151 which extend from the ends of the top panel 103 between the side panels. These extensions 151 extend beyond the side panels 105 and bottom panel 107 such that the top panel 103 is longer than the side and bottom panels. The extensions 151 provide an area of the carrier which can be gripped by high-speed machinery to facilitate opening or squaring-up of the carrier to apply the carrier to bottles.

Turning to FIGS. 16–19, a carrier 201 for a three-pack is shown. The carrier 201 is substantially similar (except for the number of bottles held by the carrier) to the six- and twelve-pack carriers. The carrier 201 includes a top panel 203, side panels 205, and a bottom panel 207 which are interconnected to form an open-ended sleeve. The top panel 203 is made of two plies and has a top ply 209 and a bottom or reinforcing ply 211.

The top ply 209 of the carrier 203 has a plurality (two or more) of surrounding apertures 213 which are evenly spaced along the top ply. In the carrier 201, three apertures are formed in the top panel in a single row. The reinforcing ply 211 has a plurality of container receiving apertures 215 which have a diameter slightly smaller than the diameter of the bottle's neck N at a point below the bottle's take-out bead T. A plurality of slits 217 radiate outwardly from the container receiving apertures 215 to define fingers or tabs 219. The container receiving apertures 215 are positioned to be concentric with the surrounding apertures 213 in the top ply 209. The surrounding apertures 213 have a diameter sized to be substantially equal to, or slightly less than, the diameter of a circle defined by the radially outermost end of the slits 217. The edge of the surrounding aperture 213 thus defines a folding point for the tabs 219. The scoring or embossing typically used to define the fold line for the tab therefore is not necessary. The carrier 201 is also provided with finger holes 223 which pass through both plies of the top panel 203 so that a consumer can easily pick up and carry the multi-pack carrier 201.

The bottom panel 207 has a single rows of apertures 227 which allow the box-top carrier 201 to be applied over a bottle. The bottom panel apertures 227 are aligned with the apertures 213 and 215 in the top panel 103 so that a bottle B can be passed through the apertures. The bottom panel apertures are generally concentric with the apertures 213 and 215 in the top panel 203.

The carrier blank 231 (FIG. 19) from which carrier 201 which is made is preferably a one-piece blank made from a single piece of material. The blank 231 has two end sections 209' and 211' which form the top and second plies 209 and 211, respectively, of the top panel 203. Blank sections 205' are hingedly connected to sections 209' and 211', respectively, and form side panels 205 of the carrier 201. The sections 205' are separated from the sections 209' and 211' by fold lines 241 and 243. A center section 207' is hingedly connected to the sections 205' along fold lines 247 and 249 to define the bottom panel 207 of the carrier 201.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although the carriers are shown without release mechanisms, release mechanisms could be incorporated into the blank, and hence into the carrier, to facilitate removal of bottles from the carrier. The release mechanisms could, for example, correspond to the release mechanisms shown in our U.S. Pat. No. 5,590,776, and in our copending application Ser. No. 895,055, now U.S. Pat. No. 5,845,776. Other release mechanism can also be used. The carriers are shown and described for use with circular bottles. The carriers could be applied to bottles of varied shape (i.e., syrup bottles, children's drink bottles, etc.) by reshaping the bottom panel apertures such that when the carrier is applied to the bottles, the outboard (and preferably the inboard) edges of the bottom panel apertures contact the bottle. The edges preferably will conform generally to the shape of the bottle when applied to the bottle. These examples are merely illustrative.

We claim:

1. A carrier for holding and transporting a plurality of bottles or other molded containers; said carrier including:

a top panel, a bottom panel, and two side panels extending between said top and bottom panels, said panels being operatively connected to define a sleeve;

said top panel having at least a top ply and a second ply; said top ply defining a plurality of surrounding apertures through which said bottle necks extend, said second ply defining a plurality of container receiving apertures formed concentrically with and having a diameter smaller than said surrounding apertures of said top ply, said second ply including a plurality of slits extending from an edge of said container receiving apertures to define a plurality of tabs around said container receiving apertures;

said bottom panel having continuous and uninterrupted edges extending between said side panels and a plurality of apertures generally aligned with said surrounding apertures and said container receiving apertures of said top panel; said bottom panel apertures engaging a surface of said bottles when bottles are placed in said carrier;

said side panels having a height such that said bottom panel is placed in tension when said bottles are placed in said carrier, such that an arc is induced in said bottom panel when said bottles are inserted in said carrier.

2. The carrier of claim 1 wherein said side panels are placed in compression when bottles are inserted in said carrier.

3. The carrier of claim 1 wherein the top and bottom panels are spaced apart from each other.

4. The carrier of claim 1 wherein said bottom panel includes a break-line generally parallel to said side panels.

5. The carrier of claim 1 wherein said side and bottom panels are of substantially the same length and said top panel has a length greater than said side and bottom panels to have an extension on at least one end of said top panel which extends beyond said side and bottom panels.

6. A carrier for holding and transporting a plurality of bottles or other molded containers; said carrier including:

a top panel, a bottom panel, and two side panels extending between said top and bottom panels, said panels being operatively connected to define a sleeve;

said top panel having at least a top ply and a second ply; said top ply defining a plurality of surrounding apertures through which said bottle necks extend, said second ply defining a plurality of container receiving apertures formed concentrically with and having a diameter smaller than said surrounding apertures of said top ply, said second ply including a plurality of slits extending from an edge of said container receiving apertures to define a plurality of tabs around said container receiving apertures;

said bottom panel having continuous and uninterrupted edges extending between said side panels and a plurality of apertures; said bottom panel apertures being radially offset from the top panel apertures such that the center of the bottom panel apertures is closer to the side panels than the center of the top panel apertures; said bottom panel apertures engaging a surface of said bottles when bottles are placed in said carrier;

said side panels having a height such that said bottom panel is placed in tension when said bottles are placed in said carrier, such that an arc is induced in said bottom panel when said bottles are inserted in said carrier.

7. The carrier of claim 6 wherein said bottom panel apertures are sized and shaped to engage said bottle at at least two points, said two points of engagement being in two different planes relative to said bottle.

8. The carrier of claim 7 wherein one of said points of engagement is an inner point and another of said points of engagement is an outer point, said inner point of engagement being in a first plane and said second point of engagement being in a second plane, said first plane being above said second plane.

9. The carrier of claim 7 wherein said bottom panel apertures are shaped to conform generally to the surface of the bottle at the point of engagement of the bottom panel aperture with the bottle received in the carrier.

10. The carrier of claim 6 wherein when bottles are received in said carrier, said side panels slope downwardly and inwardly.

11. The carrier of claim 6 wherein the top panel apertures have a center-to-center distance which is equal to, or less than, the diameter of a bottle to be carried in the carrier.

12. The carrier of claim 1 including finger holes in said top panel.

13. A carrier for holding and transporting a plurality of bottles or other molded containers; said carrier including:

a top panel, a bottom panel, and two side panels extending between said top and bottom panels, said panels being operatively connected to define a sleeve;

said top panel including finger holes and having at least a top ply and a second ply; said top ply defining a plurality of surrounding apertures through which said bottle necks extend, said second ply defining a plurality of container receiving apertures formed concentrically with and having a diameter smaller than said surrounding apertures of said top ply, said second ply including a plurality of slits extending from an edge of said container receiving apertures to define a plurality of tabs around said container receiving apertures;

said bottom panel having continuous and uninterrupted edges extending between said side panels, a plurality of apertures generally aligned with said surrounding apertures and said container receiving apertures of said top panel, and elongate holes in said bottom panel; said bottom panel apertures engaging a surface of said bottles when bottles are placed in said carrier; said bottom panel elongate holes being in line with said top panel finger holes; said bottom panel elongate holes being sized to prevent the bottom panel from being grasped when the carrier is lifted;

said side panels having a height such that said bottom panel is placed in tension when said bottles are placed in said carrier, such that an arc is induced in said bottom panel when said bottles are inserted in said carrier.

14. A carrier for holding and transporting a plurality of bottles or other molded containers; said carrier including:

a top panel, a bottom panel, and two side panels extending between said top and bottom panels, said panels being operatively connected to define a sleeve;

said top panel having at least a top ply and a second ply; said top ply defining a plurality of surrounding apertures through which said bottle necks extend, said second ply defining a plurality of container receiving apertures formed concentrically with and having a diameter smaller than said surrounding apertures of said top ply, said second ply including a plurality of slits extending from an edge of said container receiving apertures to define a plurality of tabs around said container receiving apertures;

said bottom panel having continuous and uninterrupted edges extending between said side panels and a plurality of apertures generally aligned with said surrounding apertures and said container receiving apertures of said top panel; said bottom panel apertures engaging a surface of said bottles when bottles are placed in said carrier;

said top and bottom panels including at least three rows of apertures, said rows including a row of outboard apertures adjacent the side panels and at least one row of inboard apertures between the rows of outboard apertures, the outboard apertures of the bottom panel having a center that is radially offset from a center of the outboard apertures of the top panel;

said side panels having a height such that said bottom panel is placed in tension when said bottles are placed in said carrier, such that an arc is induced in said bottom panel when said bottles are inserted in said carrier.

15. The carrier of claim 14 wherein the centers of the bottom panel outboard apertures are closer to the side panels than the centers of the top panel outboard apertures.

16. The carrier of claim 14 wherein the inboard apertures of the top and bottom panels are generally concentric.

17. The carrier of claim 14 wherein the lower panel outboard apertures are larger than the lower panel inboard apertures.

18. The carrier of claim 14 wherein said bottom panel apertures and said side panel are sized such that when bottles are received in said carrier said bottom panel comes into contact with said top panel.

19. The carrier of claim 14 wherein said carrier includes a flexible handle, said handle being movable between a first position in which it is substantially flat and a second position in which a portion of the handle extends above the carrier top panel to facilitate carrying of the carrier.

20. The carrier of claim 19 wherein said handle comprises a central handle body, a neck extending from each end of said handle body, and a head at the end of each neck; said carrier top panel including an opening through which said handle slides; said handle neck being of reduced width relative to the handle body and handle heads; said handle heads each having a pair of barbs which engage a bottom surface of the top panel when the carrier is moved to its second position.

21. The carrier of claim 20 wherein the handle head has a tapered front end.

22. The carrier of claim 20 wherein said handle head has a back edge, said barbs slits extending rearwardly from said back edge of the handle head.

23. The carrier of claim 22 wherein said barbs have a back edge angled relative to said neck; said barbs having a blunted outer corner.

24. The carrier of claim 22 wherein said handle includes a fold line at a junction between said necks and said handle heads.

25. The carrier of claim 20 wherein said handle includes a fold line between said handle body and said handle necks.

26. A carrier for holding and transporting a plurality of bottles; said carrier including:

a top panel, a bottom panel, and two side panels extending between said top and bottom panels, said panels being operatively connected to define a sleeve;

said top panel having a row of outboard apertures adjacent each side panel, said apertures having a center and being adapted to receive said bottles to retain said bottles in said carrier;

said bottom panel extending between said side panels and including a row of outboard apertures adjacent each side panel, said bottom panel outboard apertures having a center; the center of the bottom panel outboard apertures being radially offset from the center of the top panel outboard apertures.

27. The carrier of claim 26 wherein said bottom panel includes a break-line generally parallel to said side panels.

28. The carrier of claim 26 wherein the centers of the bottom panel outboard apertures are closer to the side panels than the centers of the top panel outboard apertures.

29. The carrier of claim 28 wherein said rows of top panel apertures have a center-to-center distance that is less than the greatest diameter of a bottle to be carried in said carrier.

30. The carrier of claim 28 wherein when bottles are received in said carrier, said side panels slope downwardly and inwardly.

31. The carrier of claim 26 wherein said top panel and said bottom panel each include at least one row of inboard apertures between said outboard apertures.

32. The carrier of claim 31 wherein the inboard apertures of the top and bottom panels are generally concentric.

33. The carrier of claim 31 wherein the bottom panel outboard apertures are larger than the bottom panel inboard apertures.

34. The carrier of claim 31 wherein the bottom panel apertures and the side panels are sized such that when bottles are received in said carrier said bottom panel comes into contact with said top panel.

35. The carrier of claim 26 wherein the top panel includes at least a top ply and a second ply;

said top ply having at least two rows of outboard surrounding apertures; said second ply having at least two rows of outboard receiving apertures formed concentrically with and having a diameter smaller than said surrounding apertures of said top ply; said second ply further a plurality of slits extending from an edge of said container receiving apertures to define a plurality of tabs around said container receiving apertures.

* * * * *